US006609258B1

(12) United States Patent
Clements

(10) Patent No.: US 6,609,258 B1
(45) Date of Patent: Aug. 26, 2003

(54) DISPOSABLE BAG AND FASTENER FOR A PARTS WASHER

(75) Inventor: Richard L. Clements, Redwood Falls, MN (US)

(73) Assignee: Clements Thomsen Industries, L.L.C., Redwood Falls, MN (US)

( * ) Notice: Subject to any disclaimer, the term of this patent is extended or adjusted under 35 U.S.C. 154(b) by 201 days.

(21) Appl. No.: 09/265,647

(22) Filed: Mar. 10, 1999

Related U.S. Application Data

(60) Provisional application No. 60/077,948, filed on Mar. 13, 1998.

(51) Int. Cl.[7] ..... A47K 1/06

(52) U.S. Cl. ..... 4/655; 220/495.06; 220/495.07; 220/495.08; 220/495.11; 383/11; 206/576

(58) Field of Search ..... 29/525.01; 206/576; 4/655; 220/495.06, 495.07, 495.08, 495.11; 383/7, 11

(56) References Cited

U.S. PATENT DOCUMENTS 2,970,628 A * 2/1961 Tames
3,437,258 A * 4/1969 Kugler
3,890,988 A * 6/1975 Lee
3,960,728 A * 6/1976 Otzen
4,056,114 A * 11/1977 Boutillette
4,180,113 A * 12/1979 Liebling
4,603,558 A * 8/1986 McAdams
5,028,197 A * 7/1991 Krein et al.
5,991,942 A * 11/1999 Neal

FOREIGN PATENT DOCUMENTS

DE 4001989 * 7/1991

* cited by examiner

*Primary Examiner*—Gregory Vidovich
*Assistant Examiner*—Eric Compton
(74) *Attorney, Agent, or Firm*—Westman, Champlin & Kelly, P.A.; S. Koehler

(57) ABSTRACT

A kit for a parts washer includes a flexible bag adapted to fit inside the parts washer, and a fastener to hold an open end of the flexible bag.

11 Claims, 2 Drawing Sheets

DISPOSABLE BAG AND FASTENER FOR A PARTS WASHER

This application claims the benefit of Provisional application No. 60/077,948, filed Mar. 13, 1998.

BACKGROUND OF THE INVENTION

The present invention relates to a parts washer used for cleaning automotive and industrial parts, commonly coated or covered with deposits and/or lubricating elements. More particularly, the present invention relates to a kit and a method for cleaning the parts washer of accumulated debris.

Parts washers are used in almost every automotive repair garage, industrial shop and even in many personal residences. The parts washer allows the operator to clean dirty machine parts that have been covered with dirt, grime, metal filings and lubricant compounds, such as grease or oil, in order to reuse the machine part. Commonly, the parts washer includes a reservoir or large well or basin that holds a cleaning solvent. A pump attached to the parts washer draws the cleaning solvent from the well and includes a nozzle for directed spraying.

The dirt, grime, metal filings, etc., collect in the well from repeated use of the parts washer. Periodically, the operator must collect and discard the debris from the well of the parts washer. This procedure can involve using the pump to pump a majority of the cleaning solvent into a temporary receptacle or bucket. Once enough cleaning solvent has been removed, the operator uses a scoop or small shovel to collect the debris for disposal. This is usually a very messy and time consuming job reserved for those with the least seniority in the shop. Although the procedure is done by hand using a shovel or similar device, not all of the debris is removed from the parts washer since it can accumulate in corners of the well. Once a sufficient amount of debris has been removed, the cleaning solvent is dumped back into or pumped back into the parts washer. However, since at least some of the debris remains in the well, the parts washer is not really clean after the cleaning procedure.

In view of the difficulties in cleaning a parts washer as well as the current ineffectiveness of the cleaning procedure, there is an ongoing need to provide an improved system and method for cleaning the parts washer.

SUMMARY OF THE INVENTION

A kit for a parts washer includes a flexible bag adapted to fit inside the parts washer, and a fastener to hold an open end of the flexible bag against the parts washer.

In a preferred embodiment, the fastener comprises a magnetic strip that holds an open end portion of the flexible bag against an exterior surface of the parts washer. In this manner, the flexible bag drapes over an upper perimeter edge of the wall. Preferably, the flexible bag is held against the exterior surface and disposed between the magnetic strip and the perimeter wall. Instructions can also be provided describing to the user how to locate and hold the flexible bag in the well using the magnetic strip as well as providing slits or apertures to accommodate pumps that are located within the parts washer well.

Another aspect of the present invention includes a method for operating a parts washer including inserting a flexible bag into a well of a parts washer defined by a perimeter wall and securing the flexible bag within the well.

DETAILED DESCRIPTION OF THE PREFERRED EMBODIMENTS

Figure 1:
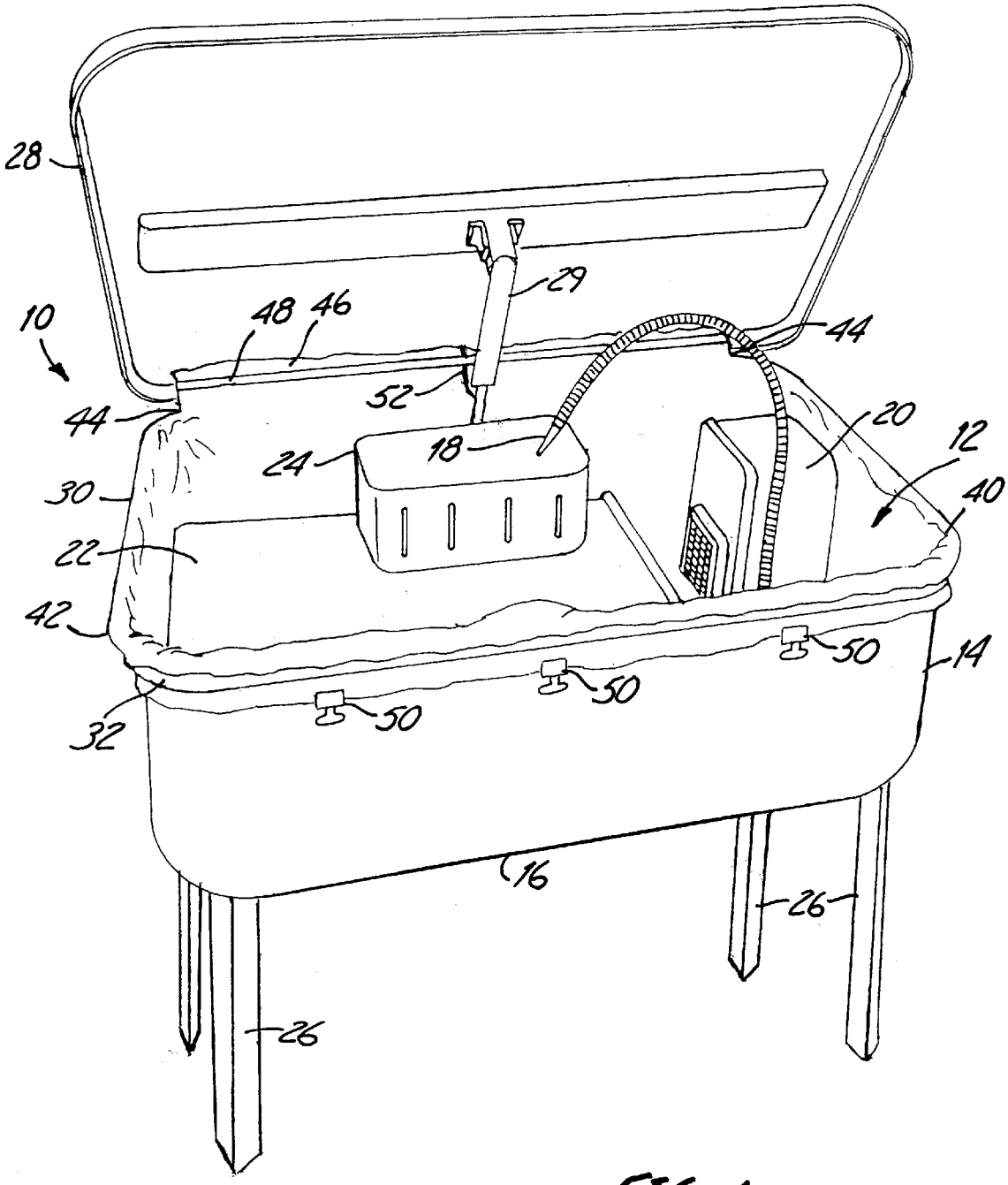
FIG. 1 is a perspective view of a parts washer with a flexible bag of the present invention disposed therein.

A typical parts washer is illustrated in FIG. 1 at 10. The parts washer 10 includes a reservoir or well 12 formed by a perimeter wall 14 and a bottom wall 16. The well 12 holds a cleaning solvent, not shown, which can be selectively dispersed through a nozzle 18 from a pump 20. In many designs, the pump 20 is at least partially located within the well 12 wherein an inlet of the pump 20 is submersed in the cleaning solvent. Commonly, the pump 20 is removably attached to an inner surface of the perimeter wall 14. A table 22, or other support platform may also be provided and is generally removable from the well 12, resting on the bottom wall 16. In the embodiment illustrated, a slotted basin 24 is attached to the table 22 and is used to retain small parts during cleaning.

The parts washer 10 can be positioned on a work bench. However, typically, the parts washer 10 includes legs 26 in order to provide a free standing unit. A hinged cover 28 is commonly provided. A cover support rod or mechanism 29 is used to retain the cover 28 in an open position.

Figure 2:
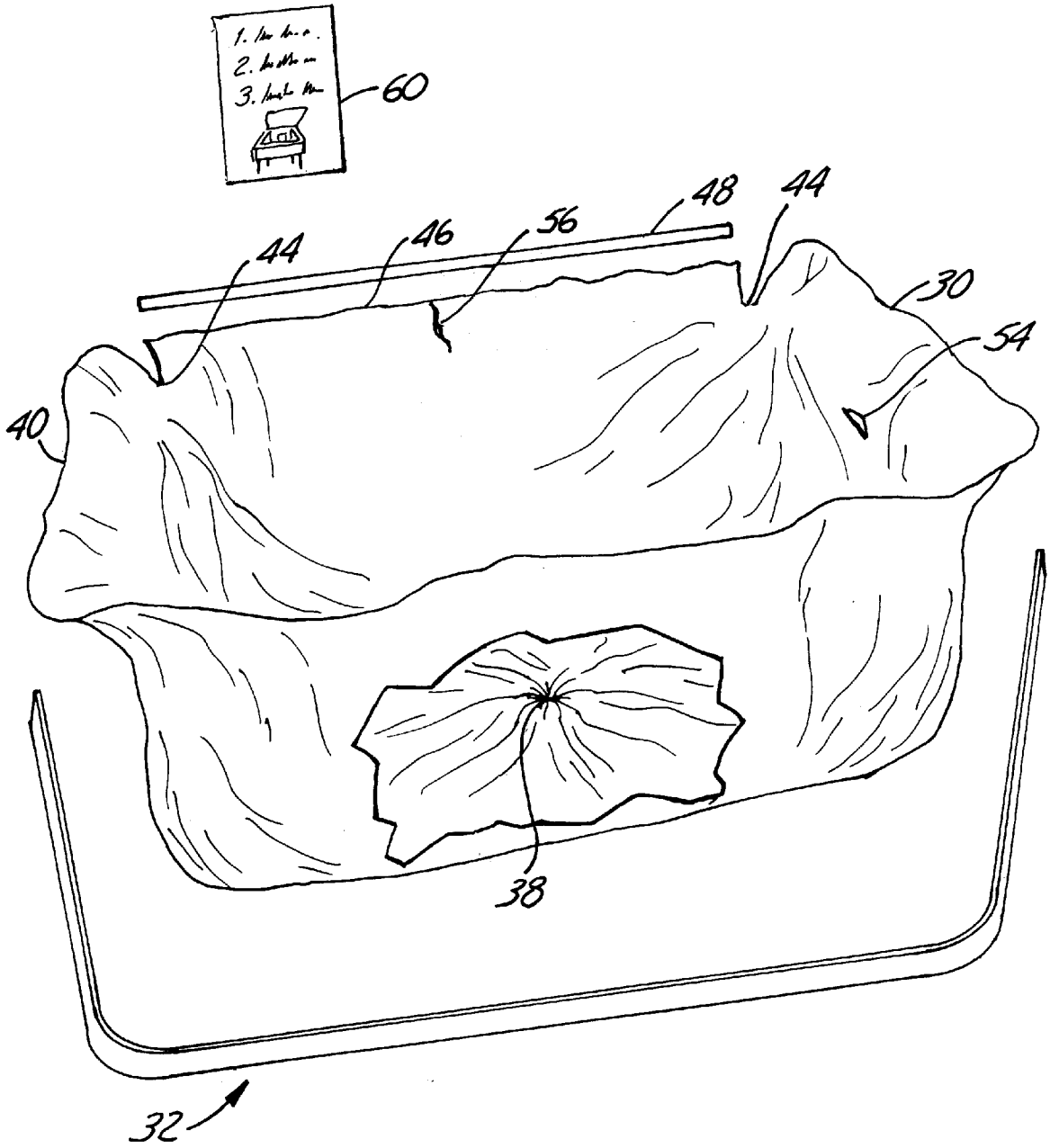
FIG. 2 is an exploded perspective view of a kit of the present invention with a portion of the flexible bag in section.

A first aspect of the present invention is a kit for the parts washer 10 enabling easy cleaning. The kit includes a flexible bag 30 illustrated in FIG. 2 that is adapted to fit inside the parts washer 10 and, in particular, the well 12. A fastener 32, herein illustrated as a magnetic strip, holds an open end of the flexible bag 30 in position against surfaces of the parts washer 10. In the embodiment illustrated, the flexible bag 30 cylindrically includes a gussetted closed end 38 and is of sufficient width and length so as to conform generally to the well 12 and extend upwardly on the perimeter wall 14. Preferably, the flexible bag 30 is of sufficient length so that an open end portion 40 thereof can be draped over an upper perimeter edge 42 of the perimeter wall 14, as illustrated in FIG. 1. In this manner, the magnetic strip 32 is disposed over the open end portion 40 of the flexible bag 30 and is magnetically attracted to an exterior surface of the perimeter wall 14. The magnetic strip 32 is particularly useful since it can hold a majority or continuous portion of the open end portion 40 of the flexible bag 30 that has been draped over the upper perimeter edge 42. If in the event the parts washer 10 includes the hinge cover 28, small cuts or slits 44 can be provided so as to form a flap 46. A separate magnetic strip 48 is provided to hold the flap 46 on an inner surface of the cover 28.

At this point, it should be understood that other fasteners can also be used to hold the open end portion 40 of the flexible bag 30 in position on the parts washer 10. For instance, separate, spaced-apart magnets can be positioned periodically along the perimeter wall 14 to hold the open end portion 40. In another embodiment, a spring band, such as a helically wound spring, a rubber band, or other elastic band can also be used. The band can encircle the perimeter wall 14, or only be used on portions of the perimeter wall 14 that have the open end portion 40 of the flexible bag 30 draped thereover. The band could look similar to the magnetic strip 32 in FIG. 1. Likewise, individual clips 50 separate from or attached to the perimeter wall 14 can also be used to hold the open end portion of the flexible bag 30.

Each of the aforementioned fasteners, although suitable, may have functional disadvantages. For instance, the helically wound spring may not grip and hold the open end portion 40 of the flexible bag 30, as well as the magnetic strip 32. If the band is elastic, the material chosen for the spring band would have to be relatively inert to the cleaning solvent used in the parts washer 10. Individual clips 50, although capable of securely holding the open end portion 40 of the flexible bag 30 could be lost if attached separately to the parts washer 10. If the individual clips So are attached to the parts washer, existing parts washers would have to be retrofitted.

It should be noted that the flexible bag 30 can also take other forms. For example, the flexible bag 30 can be box-like, having side and/or a bottom panels sealed together.

Another aspect of the present invention includes a method for operating the parts washer 10 including the steps of inserting the flexible bag 30 into the well 12 of the parts washer 10 defined by the parameter wall 14; and securing the flexible bag 30 within the well 12. In operation, the pump 20 can be used to pump the cleaning solvent from the well 12 into a temporary container. Any removable table 22 or basin 24 is then removed. The pump 20 is also detached from the parameter wall 14. The flexible bag 30 is placed in the well 12, and as in the illustrative embodiment, the open end portion 40 thereof is draped over the upper parameter edge 42. If desired, the flexible bag can be cut to provide the flap 46. Likewise, the flexible bag 30 can be cut, punctured or torn so as to form an aperture 54 through which a mounting bracket, cord or other element of the pump 20 can project through when the pump 20 is mounted to the inside surface of the perimeter wall 14. As used herein, "cutting" shall also mean tearing or puncturing the flexible bag 30. If the parts washer 10 includes the mechanism or support rod 29, an additional slit 52 can be formed in the open end portion 40 of the flexible bag 30, as desired.

After securing the flexible bag 30 to the parts washer 10, the pump 20 can be reattached through the aperture 54 and clean solvent can be poured into the well 12, which generally holds the flexible bag 30 against the inside of the inner surface of the parameter wall.

When it is time to clean the parts washer 10, the clean solvent once again can be pumped out of the well 12 with the pump 20. The pump 20 is then removed along with any tables 22 or basins 24. The magnetic strips 32 and 48, or other fasteners, are then removed and the open end portion 40 of the flexible bag 30 is gathered and tied. The flexible bag and debris collected therein can then be properly disposed of. The kit can include additional flexible bags 30 which can then be disposed in the parts washer 10 and secured thereto in the manner described above. An instruction guide or other printed material 60 can be provided with text or illustrations describing the method above for installing the flexible bag 30 into the parts washer 10.

Although the present invention has been described with reference to preferred embodiments, workers skilled in the art will recognize that changes may be made in form and detail without departing from the spirit and scope of the invention.

What is claimed is:

1. In combination with a parts washer comprising a container adapted to contain a solution and a hinged cover for covering the container, a flexible bag adapted to fit inside a well of the container, a magnetic strip adapted to hold a first portion of an open end of the flexible bag to the hinged cover, and a fastener to hold a second portion of the open end of the flexible bag to the walls of the container.

2. The combination of claim 1 wherein the fastener comprises a magnetic strip.

3. The combination of claim 1 wherein the flexible bag is of a length from the closed end to the opened end to overhang an upper perimeter edge of the parts washer.

4. The combination of claim 1 wherein the flexible bag comprises a cylindrical tube with a closed end.

5. The combination of claim 4 wherein the closed end is gussetted.

6. The combination of claim 1 wherein the flexible bag is box-like having a rectangular bottom.

7. The combination of claim 1 and further comprising a second flexible bag substantially identical to the first-mentioned flexible bag.

8. The combination of claim 1 and further comprising printed media having instructions for installing the flexible bag into the parts washer.

9. The combination of claim 8 wherein the instructions pertain to cutting the flexible bag at a selected location.

10. The combination of claim 9 wherein the instructions pertain to forming an aperture in the flexible bag.

11. The combination of claim 9 wherein the instructions pertain to forming a flap along the perimeter edge of the flexible bag.

* * * * *